United States Patent [19]

Gershoni

[11] Patent Number: 4,756,261

[45] Date of Patent: Jul. 12, 1988

[54] AUTOMATIC SEWING SYSTEM AND METHOD

[75] Inventor: Haim Gershoni, Tel Aviv, Israel

[73] Assignee: The Shenkar College of Textile Technology and Fashion, Pamat Gan, Israel

[21] Appl. No.: 731,098

[22] Filed: May 6, 1985

[51] Int. Cl.[4] ..... D05B 21/00; D05B 3/12

[52] U.S. Cl. ..... 112/262.3; 112/265.1; 112/121.12; 112/DIG. 2; 112/104

[58] Field of Search ..... 112/121.12, 121.11, 112/121.15, 121.29, 2, DIG. 2, 262.3, 265.1, 104

[56] References Cited

U.S. PATENT DOCUMENTS

| | | | |
|---|---|---|---|
| 3,531,107 | 9/1970 | Rovin et al. | 112/121.11 U X |
| 3,611,961 | 10/1971 | Lopez et al. | 112/121.29 X |
| 3,670,675 | 6/1972 | Rovin et al. | 112/121.12 |
| 4,425,858 | 1/1984 | Hargett | 112/121.12 |
| 4,498,404 | 2/1985 | Sadeh | 112/121.12 |

FOREIGN PATENT DOCUMENTS

| | | | |
|---|---|---|---|
| 6901765 | 8/1970 | Netherlands | 112/121.11 |

OTHER PUBLICATIONS

Johannes Sahl KG catalog sheet KLS with Cutter (1 sheet-A1).
Johannes Sahl KG catalog sheet ZTS (1 sheet-A2).
Johannes Sahl KG catalog sheets ENS 480 (2 sheets-A3).
Johannes Sahl KG, catalog sheets KLS 600S/B+CCS240 (2 sheets-A4).
Pfaff catalog sheets (2 sheets-B).
Pentel Robert catalog sheets Precision Assembly Robot Series (12 sheets-C1).
General Electric catalog, sheets, The GE Series One (4 sheets-C2).
General Electric catalog sheets, the GE Series Three (4 sheets-C3).
Seiko Instruments & Electronics Ltd., catalog sheets RT3000 (2 sheets-C4).
Dainichi-Sykes catalog sheets Industrial Robots, Controllers and Manipulators (8 sheets-C5).
ASEA catalog sheets Industrial Robot MHU (12 sheets-C6).
Adler Collar System catalog sheets (10 sheets-C7).
GMF Robotics catalog sheets (4 sheets-C8).

*Primary Examiner*—Peter Nerbun
*Attorney, Agent, or Firm*—Body, Vickers & Daniels

[57] ABSTRACT

An automatic sewing system comprising apparatus for receiving a plurality of precisely positioned workpieces of web material, such as cloth, to be sewn, a plurality of work stations, and apparatus for transferring individual ones of the plurality of precisely positioned workpieces sequentially from one of the plurality of work stations to another while maintaining the workpieces in precise predetermined positional orientation at the beginning and end of an operation at each of the plurality of work stations.

3 Claims, 9 Drawing Sheets

AUTOMATIC SEWING SYSTEM AND METHOD

FIELD OF THE INVENTION

The present invention relates to sewing machinery generally and more particularly to automotive sewing systems.

BACKGROUND OF THE INVENTION

Automatic sewing machinery is known in the prior art and is employed in the sewing industry for specific operations. For example, there exist machines for sewing pockets onto men's shirts and similar functions. Such machines are quite complicated and expensive and are totally dedicated to the operation for which they are designed. Thus, for example, the machine designed for sewing pockets onto shirts cannot be converted to another operation is shirts without pockets are demanded by the market.

Programmable sewing machines presently exist and are known for carrying out selected sewing functions. Such machines nevertheless required skilled manual feeding of the cloth into the machine, and during the sewing operation. For the sake of clarity, feeding of cloth into the machine prior to sewing will be referred to as "positioning to the needle" and feeding of the cloth during the sewing operation will be referred to as "guiding".

The automatic sewing machinery presently known and in use may thus be appreciated to have the disadvantage that it cannot be used flexibly in response to changes in customer taste and demand. Therefore the garment industry has remained essentially an unautomated industry at the sewing level.

In conventional sewing operations, material is supplied to each workstation in bundles. Even if these bundles come directly from the cutting floor, they are normally not ordered with sufficient precision to allow mechanized pick up. Therefore, a skilled operator is required to properly position the workpiece to the needle. Following each sewing operation, the workpieces are usually placed in a hamper without maintaining their positional orientation. Thus a skilled operator is also required to position to the workpiece to the needle in every subsequent operation.

SUMMARY OF THE INVENTION

The present invention seeks to provide an automatic sewing system which overcomes the disadvantages of the prior art and provides programmable multi-station sewing operations.

There is thus provided in accordance with a preferred embodiment of the present invention an automatic sewing system comprising apparatus for receiving a plurality of precisely positioned workpieces of web material, such as cloth, to be sewn, a plurality of work stations, and apparatus for transferring individual ones of the plurality of precisely positioned workpieces sequentially from one of the plurality of work stations to another while maintaining the workpieces in precise predetermined positional orientation at the beginning and end of an operation at each of the plurality of work stations.

Further in accordance with a preferred embodiment of the present invention, each of the plurality of work stations comprises at least one sewing work station including a programmable sewing machine and guiding apparatus for maintaining precise orientation of the workpiece during processing.

Additionally in accordance with a preferred embodiment of the present invention, the guiding apparatus may be removable and selectably positionable so as to enable each work station to be selectably and changeably designed for a desired sewing function.

Further in accordance with a preferred embodiment of the present invention, the apparatus for transferring comprises programmable robot apparatus and low suction gripper apparatus for engagement of the workpiece.

Additionally in accordance with a preferred embodiment of the present invention, the apparatus for receiving receives a plurality of different precisely positioned workpieces and the apparatus for transferring is operative to transfer individual workpieces of each type of separate work stations for preliminary operations and then to position different precisely positioned individual workpieces onto each other in precise positional orientation for being sewn together at additional work stations.

Further in accordance with a preferred embodiment of the invention, there is also provided apparatus for precisely folding individual workpieces prior to sewing.

Additionally in accordance with a preferred embodiment of the invention, there is provided an automatic sewing method comprising the steps of:

receiving a plurality of precisely positioned workpieces of web material to be sewn; and transferring individual workpieces sequentially to a plurality of work stations while maintaining the workpieces in precise predetermined positional orientation.

Additionally in accordance with an embodiment of the invention there is provided an automatic sewing method wherein the step of transferring comprises the step of operating programmable robot apparatus and low suction gripper apparatus for engagement of the workpiece.

Further in accordance with an embodiment of the invention there is provided an automatic sewing method as described hereinabove and wherein the step of receiving includes the step of receiving a plurality of different precisely positioned workpieces and the transferring step includes the step of transferring different individual workpieces to separate work stations for preliminary operations and then to precisely position different individual workpieces onto each other for being sewn together at additional sewing work stations.

BRIEF DESCRIPTION OF THE DRAWINGS

The present invention will be understood and appreciated more fully from the following detailed description taken in conjunction with the drawings wherein.

DETAILED DESCRIPTION OF A PREFERRED EMBODIMENT

Figure 1:
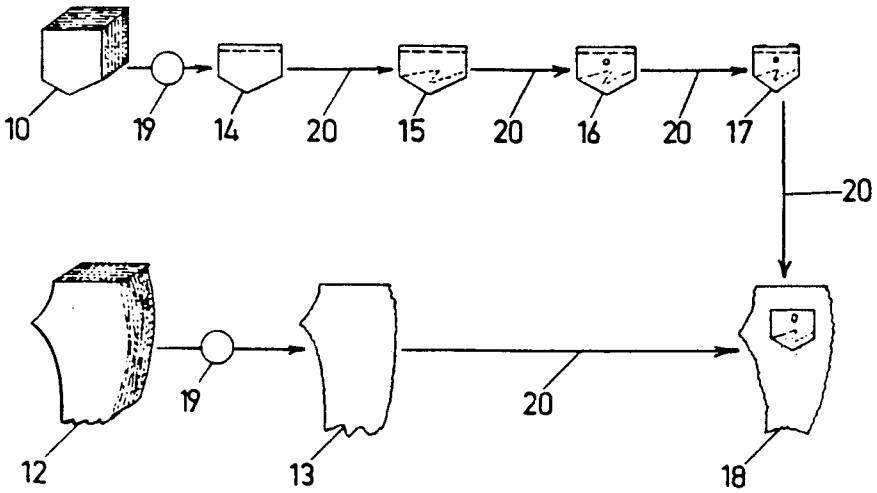
FIG. 1 is a functional block diagram illustration of an automatic sewing system constructed and operative in accordance with a preferred embodiment of the invention.

Reference is now made to FIG. 1, which illustrates an automatic sewing system constructed and operative in accordance with a preferred embodiment of the present invention.

In the illustrated automatic sewing system, there are shown two or more stacks 10 and 12 of workpieces of fabric to be sewn. It is a particular feature of the present invention that the individual workpieces of fabric are moved from the original stacks and precisely placed at the starting point of the sequence. Where the individual workpieces are maintained in precise registration with each other in the stacks, mechanical means may be employed for moving the individual workpieces to the starting point. Otherwise, a human operator, indicated by reference numeral 19, provides the precise positioning required at the beginning of the sequence.

As seen in FIG. 1, workpieces from stack 10 are precisely positioned to the needle in a hemming machine 19, while workpieces from stack 12 are precisely positioned to the needle in a serging machine 13, so as to enable precise positioning of the workpieces throughout the subsequent automatic processing.

Each workpiece element is moved sequentially through a number of work stations. In the illustrated embodiment, a stack 10 of trouser back pockets is passed through a plurality of work stations which include, for example, hemming 14, decoration 15, button holing 16 and creasing 17. Each of these work stations operates automatically and is based on precise positioning of the workpiece as it is provided to the work station and at the completion of the operation provided thereat.

Following preliminary processing of each given workpiece of a first type, such as the trouser back pocket, it is provided to a joining work station 18 in a precise and predetermined orientation. There is simultaneously or previously supplied to the joining work station 18 in precise predetermined orientation a workpiece of the second type, such as a trouser back panel. This workpiece, which originated in stack 12, went through a number of manufacturing operations, such as serging 13, more or less at the same time as the preliminary processing of the workpiece of the first type.

It is a particular feature of the present invention, that in contrast to conventional operations in garment manufacturing, the individual workpieces, once they are removed from the original stacks are normally not restacked but rather are maintained in continuous processing while in the automated series of operations.

This technique and arrangement of work stations ensures that continuous and parallel processing of the component of the garment is carried out, thereby reducing significantly the overall time of manufacture and the conventional stock of work in process which contribute greatly to the cost of garment manufacture.

It will be appreciated by a person skilled in the art that following the joining step there may follow further automatic processing of the joined workpieces and even joining thereof to other workpieces which may be automatically or manually preprocessed.

A key element in the automatic sewing apparatus of the present invention is the apparatus for precisely transferring the individual workpieces to the work stations and from work station to work station in precise predetermined orientation. According to a preferred embodiment of the invention, the transferring apparatus, indicated schematically by reference numeral 20, comprises one or more programmable robots having associated gripper devices (not shown). These robots may be of the rotary type, i.e. operating with workstations arranged generally in a circle about a fixed vertical axis, or alternatively of the linear type, operating with workstations arranged generally along a longitudinal axis, a hybrid of the two or a combination of these types and others, for example. Commercially available programmable robots suitable for use in the automatic sewing system of the present invention include the Schrader Bellows Motion Mate, manufactured by Schrader Bellows, a division of Scovill Industries of Akron, Ohio, U.S.A., and the Unimation Panda.

Figure 2:
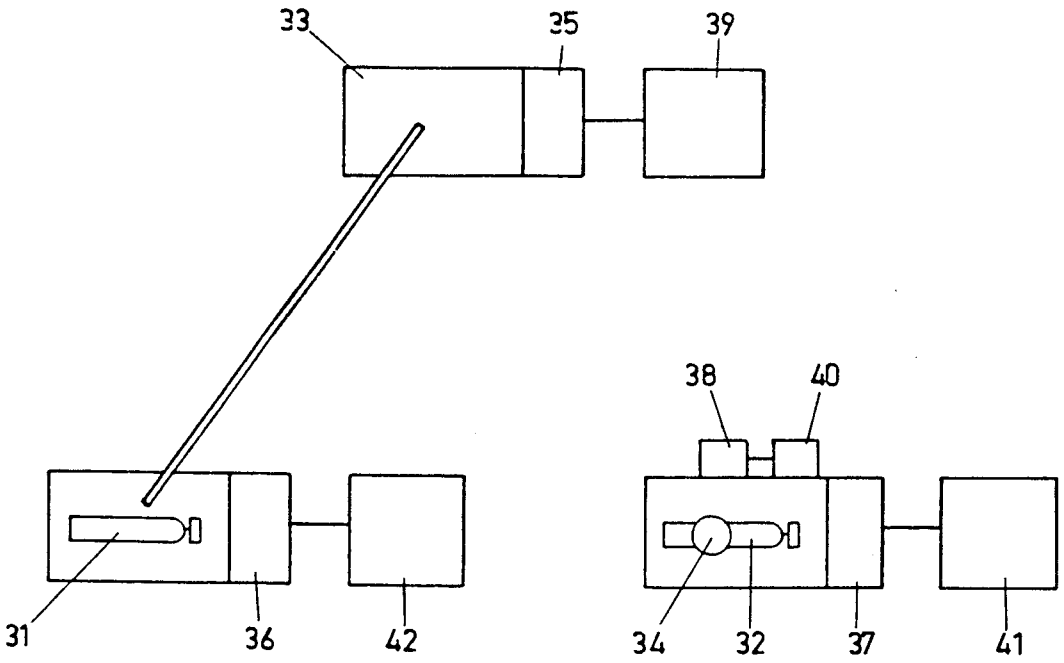
FIG. 2 is a block diagram illustration of a unit of the automatic sewing system of FIG. 1.

Reference is now made of FIG. 2 which is a simplified block diagram illustration of a unit portion of the automatic sewing system of FIG. 1. In the embodiment illustrated in FIG. 2, there are provided first and second sewing machines 31 and 32 and a pick and place robot 33 for precisely transferring workpieces from machine 31 to machine 32 and for selectably turning workpieces. Typically, sewing machines 31 and 32 are each provided with corresponding computer controllers 36 and 37 and programmers 41 and 42. Pick and place robot 33 is provided with a computer controller 35 and a programmer 39.

A sewing robot 34 may be associated with one of the sewing machines, such as sewing machine 32, for moving fabric on the sewing table, for positioning the fabric to the needle or for guiding it during operation of the sewing machine. The sewing robot 34 is typically provided with its own computer controller 38 and programmer 40. The computer controllers and programmers may be standard commercially available components as are available from IBM and Cutler Hammer, for example.

The sewing robot may have a number of functions including:

- reorienting the fabric after a segment is sewn and prior to sewing of the next segment;
- moving the fabric while sewing to aid in the guiding process;
- moving the fabric to keep it flat during sewing;
- prepositioning the fabric prior to sewing in cases where the pick and place robot was unable to place the fabric in the proper place;
- post positioning the fabric after sewing to aid the pick and place robot which may not be able to reach the fabric.

The various elements of the apparatus of FIG. 2 work together typically by means of intercommunications between their respective computer controllers, which indicate to the apparatus responsible for each subsequent operation that the preceding operation has been completed. For example, robot 33 awaits a signal indicating that sewing machine 31 has finished its operation and that the fabric is ready for pick up. When sewing machine 31 is ready, its computer controller 36 signals the computer controller 36 of robot 33 to that effect. Robot 33 then moves the fabric to sewing machine 32. Once the transfer has taken place, controller 35 signals sewing machine 32 to begin operation and may also signal sewing machine 31 that it can begin work on the next workpiece. Similarly, robot 33 communications with robot 34 and with other elements of the system.

Alternatively, centralized control of all of the apparatus may be provided. As a further alternative, non-dedicated, portable, programmers may be employed in connection the robots and/or the sewing machines. Programs may be stored in the various computer controllers by means of conventional apparatus such as magnetic disks or tapes or EPROMs. Where EPROMs are employed, the programs for the robots and the sewing machines can be changed simply by replacing pre-programmed EPROMs.

Figure 3:
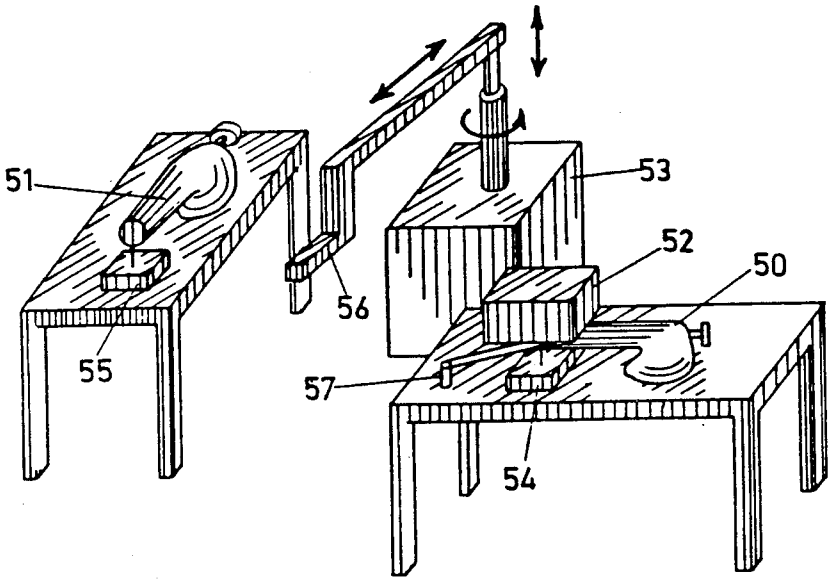
FIG. 3 is a pictorial illustration of the unit illustrated in FIG. 2.

Reference is now made to FIG. 3 which illustrates pictorially a typical unit portion of a sewing system according to the present invention and corresponds to FIG. 2. The apparatus of FIG. 3 includes first and second programmable sewing machines 50 and 51, such as machines manufactured by Pfaff, a Sensewmat or Singer 4000. Alternatively conventional sewing machines with programmable motors such as the Efka and Quick Rotan motors may be employed. The machines are equipped with guiding devices 54 and 55 respectively, such as cams, which guide a workpiece fabric moving device and the workpiece in a conventional manner during sewing.

The guiding devices enable the sewing machine to precisely perform the desired sewing function on a workpiece which is precisely positioned with respect thereto and to position the workpiece in a predetermined precise position upon completion of the desired sewing function.

Sewing machine 50 is also equipped with a sewing robot 52, of conventional construction and having an associated gripper 57. Sewing robot 52 is operative to reorient the fabric during sewing or between segments of seams. A pick and place robot 53 having an associated gripper 56 is operative to communicate with sewing machines 50 and 51 and also with sewing robot 52.

In operation, the pick and place gripper 56 is moved to a position adjacent sewing machine 51 and awaits a signal from sewing machine 51 that it has completed its operation. Robot 53 then moves gripper 56 to a precise location on the finished piece of fabric in machine 51. The gripper 56 grasps the fabric and moves it to a predetermined position at sewing machine 50. When sewing robot 52 and sewing machine 50 are ready to receive the new piece of fabric, they signal robot 53 which places the cloth into the exact entry position for the operation to be performed by sewing machine 50.

Robot 53 then removes its gripper 56 from the path of the sewing robot gripper 57 and signals sewing machine 50 to begin its operation. Robot 53 then moves gripper 56 back to machine 51 to start a new cycle.

It is a particular feature of the present invention that the sewing apparatus at the work station is conventional, relatively inexpensive and universely programmable sewing apparatus. Such conventional apparatus includes unmovable and selectably configurable guiding apparatus selectably associated with the sewing apparatus to ensure correct positioning of the workpiece throughout the sewing operation.

Normally, the transfer apparatus 20 (FIG. 1) does not participate in positioning of the workpiece during a sewing operation at a given work station, this being done by the programmable sewing apparatus. Alternatively, the transfer apparatus may participate in such positioning or, as a further alternative, auxiliary robot apparatus may be provided for this purpose.

Figure 4A:
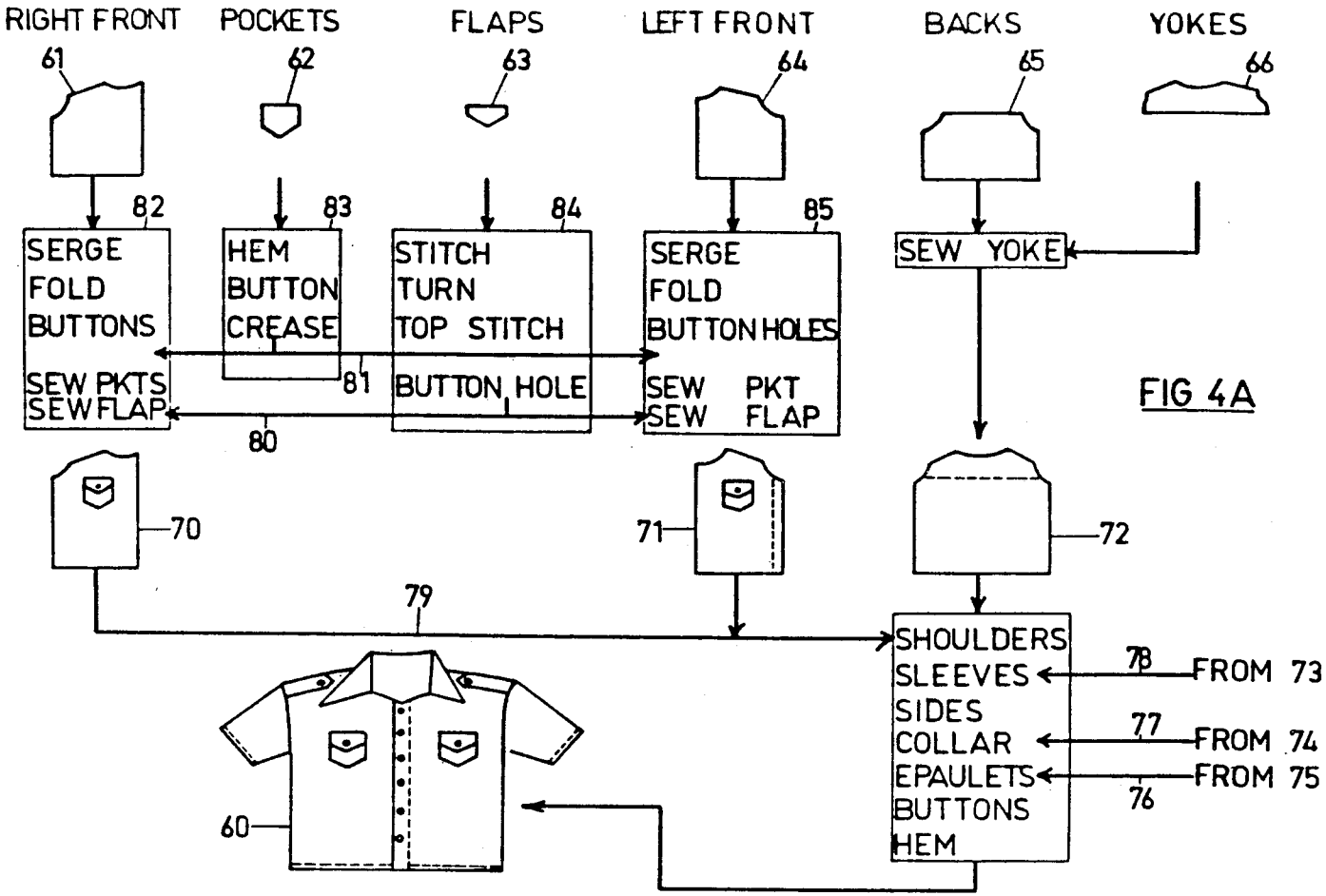
FIGS. 4A and 4B are a pictorial flow chart illustration of a sewing operation carried out in accordance with the present invention.
Figure 4B:
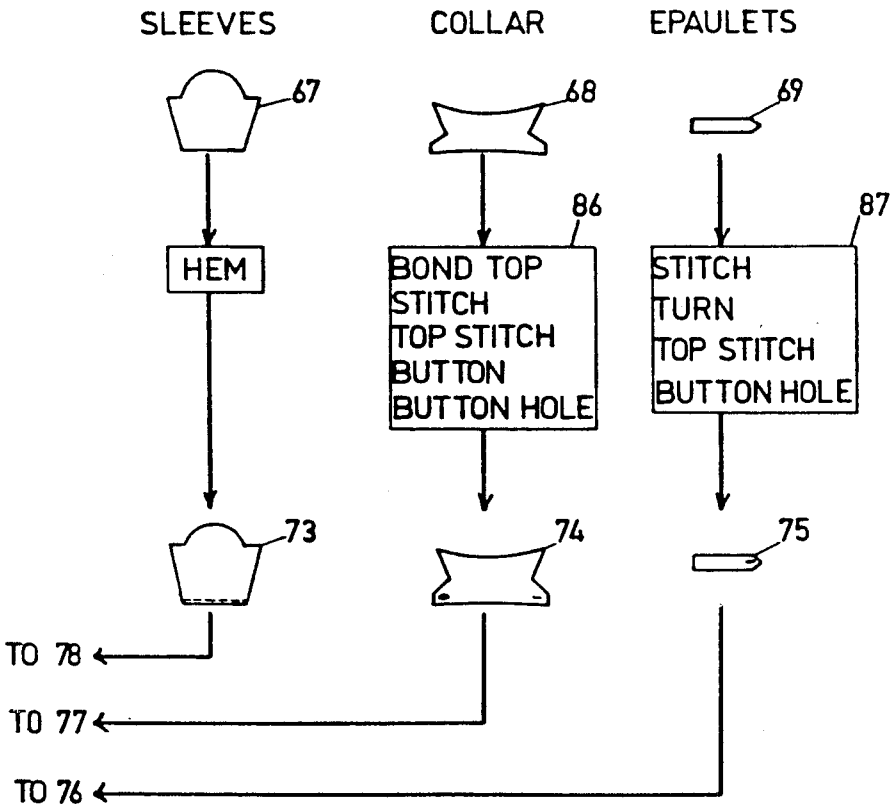

Reference is now made to FIGS. 4A and 4B which is a flow diagram illustration of a shirt manufacturing operation in accordance with the present invention. The individual cut elements 61–69 are illustrated at the top of the diagram. Below each element are listed in blocks 82–87, the operations which are carried out thereon to produce the respective subassemblies 70–75. The respective subassemblies are then combined in a final garment 60.

Horizontal lines 76–81 indicate transfers of one element to another. Transfers 78–79 can be robot transfers. Operations 82–87 are all automatic and can be carried out in accordance with the present invention.

Thus, it may be appreciated that out of a total of 35 operations involved in producing the illustrated garment, 24 (i.e. 69%) can be performed automatically in accordance with the present invention.

Reference is now made to FIGS. 5–14 which illustrate various embodiments of gripper apparatus useful in the transfer apparatus of the present invention.

Figure 5:
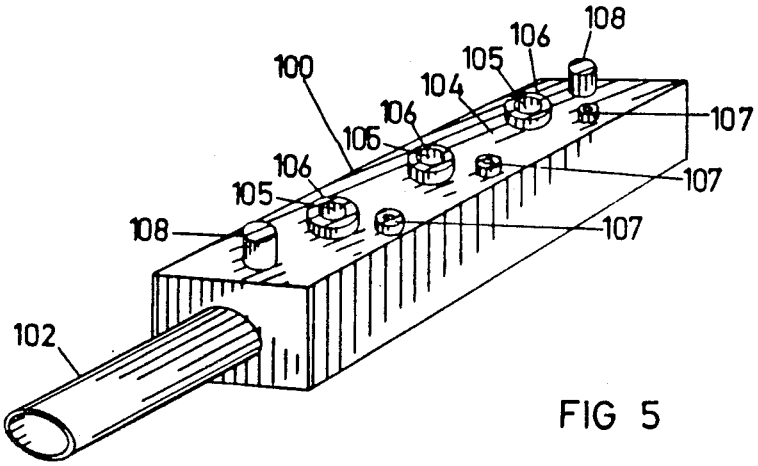
FIG. 5 is an isometric view of the working face of one embodiment of a gripper useful in the apparatus of FIG. 1.

FIG. 5 illustrates a preferred embodiment of the gripper comprising a generally hollow body 100, the interior of which communicates with a tube 102 for connection to a vacuum pump. The body 100 defines an operative face 104 having a plurality of holes 105, typically three in number, each fitted with a protruding tubular collar 106, typically formed of rubber. Additionally along one or both edges of the body 100 there may be provided a plurality of smaller holes 107. According to one embodiment of the invention there are provided on face 104 a plurality of spacer studs 108 which protrude slightly beyond collars 106. Alternatively either or both of the collars 106, 107 and studs 108 may be omitted.

Figure 6:
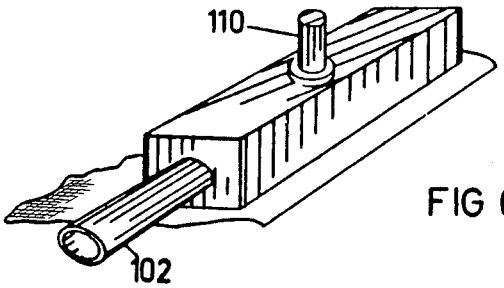
FIG. 6 is an isometric view of the gripper of FIG. 5 formed with a first type of suspension.
Figure 7:
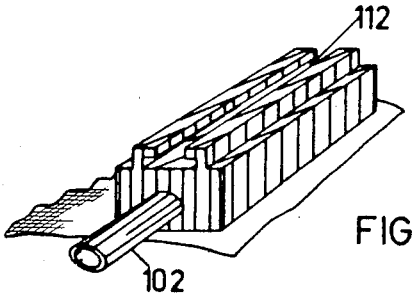
FIG. 7 is an isometric view of the gripper of FIG. 5 formed with a secod type of suspension.

During operation, the body 100 is mounted onto a robot arm such that face 104 is downwardly directed, as by means of a mounting element 110, shown in FIG. 6 or a slotted track 112, shown in FIG. 7, or any other suitable mounting means.

Upon application of a suitable vacuum to the interior of body 100, the gripper is operative to pick up a piece of cloth which constitutes an individual workpiece. The amount of vacuum applied depends on the size and weight of the workpiece sought to the engaged, as well as its composition, the air permiability of its structure and its frictional qualities.

It has been determined experimentally that when a vacuum of 15 cm of mercury, i.e. about 0.2 ATM, is applied to the gripper of the type shown in FIG. 1, having holes 105 of diameter 6 mm and holes 107 of diameter 3 cm in engagement with denim cloth, an airflow of about 100 liters per minute is provided and the gripper is able to lift about 240 grams, which is approximately twice the weight of a front panel of trousers.

In operation, the vacuum is applied through holes 105 and 107 and the collars 106 tend to reduce sliding of the cloth relative to the gripper. The auxiliary foles 107 serve to support the edge of the cloth, which would otherwise tend to hang down and double back over the larger holes. Spacer studs 108 serve to space the collars 106 from the cloth and enable the gripper to rest thereon when engaging the cloth. It is appreciated that precise control of the vacuum and of the positioning of the gripper relative to the cloth may obviate the need for spacer studs 108.

Figure 14:
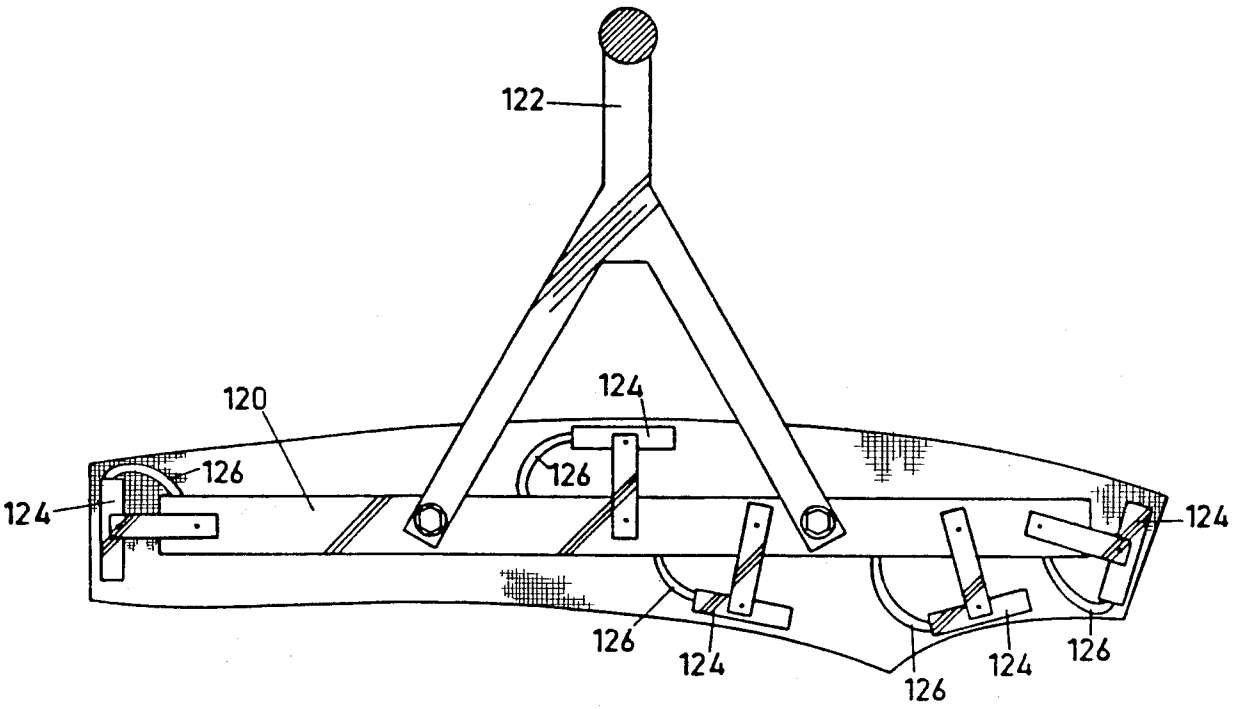
FIG. 14 is a plan view of a gripper assembly constructed and operative in accordance with a preferred embodiment of the present invention.

The grippers illustrated in FIGS. 5–7 having one or more holes may be used individually or may be assembled in arrays to lift relatively larger workpieces. The shape and design of the individual grippers and their orientation and arrangement in a given array may be changed to fit the particular function. Where gripper assemblies are employed, a plurality of grippers are assembled on a frame 120, as illustrated in FIG. 14. The frame 120 is mounted on a robot arm 122 and carries a plurality of individual grippers 124, each associated with a vacuum hose 126 connected to a central vacuum source, not shown. The assembly is shown engaging a trouser panel. It is appreciated that the grippers are arranged to control the edges of the panel.

It is noted that a given gripper assembly may employ a plurality of grippers, only selected ones of which are employed in any given operation.

Figure 8:
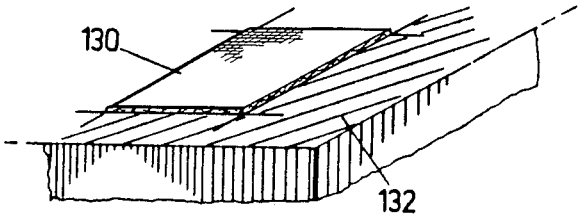
FIGS. 8–13 illustrate various stages in the handling of a piece of cloth in accordance with an embodiment of the present invention.
Figure 9:
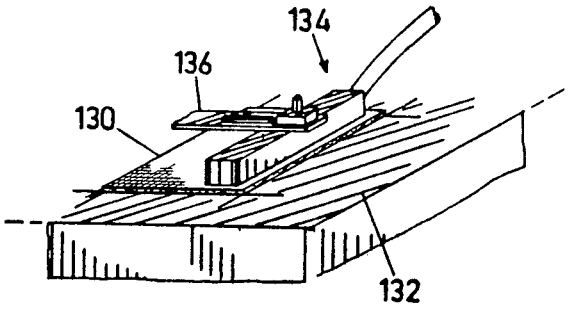
Figure 10:
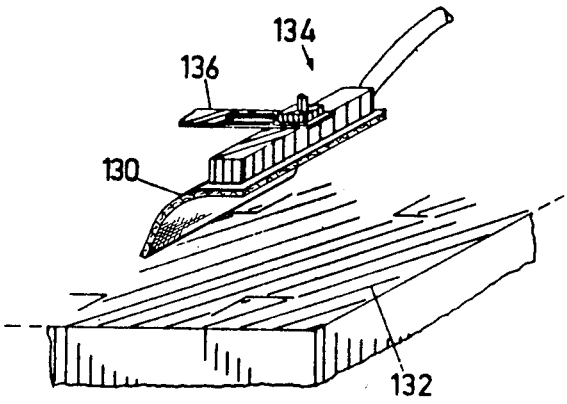
Figure 11:
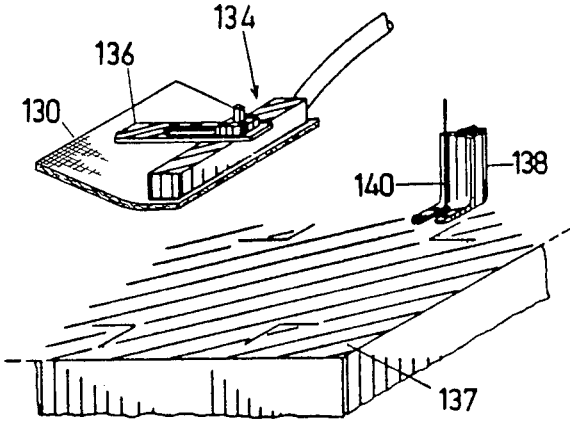
Figure 12:
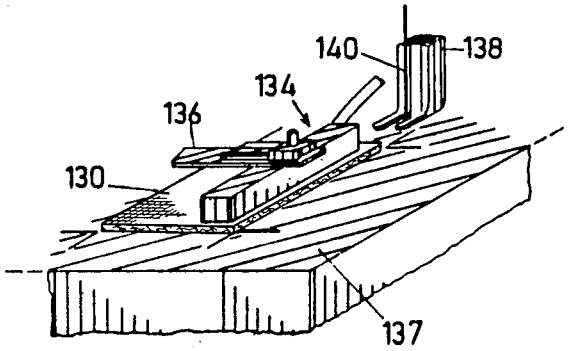
Figure 13:
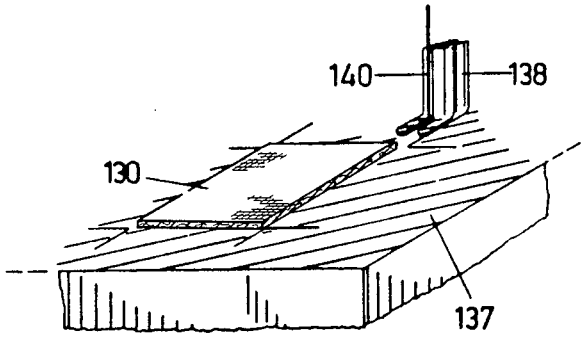

Reference is now made to FIGS. 8–13 which illustrate several operational stages of cloth engagement with the aid of a robot fitted with a gripper according to the present invention. In FIG. 8, a piece of cloth 130 rests in a predetermined orientation on a table 132 ready to be picked up. In FIG. 9, a gripper 1345 of the type shown in FIG. 7, mounted at the end of an arm 136 of a robot is caused to bear on coth 130 while the vacuum is applied. In consequence, the cloth 130 is attached to the gripper 134 and lifted from table 132 as shown in FIG. 10. In FIG. 11, the cloth is transported to another work station 137 fitted with a sewing machine, indicated by foot 138 and needle 140. In FIG. 12, the cloth has been oriented at work station 137 in its precise desired position with respect to the sewing machine foot 138. When the vacuum is released and the gripper removed from work station 137, the cloth 130 is precisely positioned for processing at the work station.

It is appreciated that the gripper apparatus described hereinabove is useful not only for workpiece transfer but also for other functions such as folding of the workpiece.

It will be appreciated by persons skilled in the art that the present invention is based on maintaining precise positioning of the workpiece throughout the various processing steps. Through maintenance of precise positioning, control of the individual work stations is simplified.

It is a further feature of the present invention that parallel processing of sub-components of the garment takes place so as to minimize the amount of goods being processed at any given time.

The present invention is not limited to the precise configuration and components described hereinabove for the purposes of explanation. Rather the scope of the invention is defined only by the claim which follow:

I claim:

1. An automatic sewing system adapted to perform a plurality of sequential sewing operations each corresponding to one or more of a plurality of workpieces, said system comprising:

means for receiving said workpieces in precise positions determined by the sequential sewing operations to be performed thereon;

a plurality of work stations each adapted to perform a sewing task comprising part of said sequential operations; and selectably programmable means for transferring said precisely positioned workpieces from said means for receiving to and between said work stations in a plurality of orders each determined by one of said plurality of sequential sewing operations while maintaining the workpiece in precise predetermined positional orientation, said selectably programmable means comprising a robot which may be programmed for selected operative engagement with at least one of said plurality of work stations.

2. An automatic sewing method for performing a plurality of different sequential sewing operations each comprising a series of sewing tasks and corresponding to one or more of a plurality of different workpieces to be sewn, said method comprising the steps of:

(a) providing a plurality of said workpieces each in a precise initial position determined by the sequential sewing operation being performed thereon;

(b) providing a plurality of sewing work stations each adapted to perform a sewing task comprising a part of said sequential operations; and (c) automatically transferring said workpieces from said initial positions to and between said pluality of work stations each in an order determined by the one of said different sequential sewing operations being performed thereon while maintaining said workpiece in precise predetermined positional orientation, said transferring step comprising the step of operating a selectively programmable robot.

3. A selectable task automatic sewing system comprising:

means for receiving a plurality of types of precisely positioned workpieces;

a plurality of work stations comprising at least one sewing machine and guiding apparatus for maintaining precise orientation of a workpiece being processed thereat, said guiding apparatus being removable and selectively positionable so as to enable the associated work station to be selectably and changeably adapted for a desired sewing function;

means for transferring said precisely positioned workpieces sequentially to said plurality of work stations while maintaining the workpieces in precise predetermined positional orientation, said means for transferring comprising programmable robot apparatus and low suction gripper apparatus for engagement of the workpieces, and being operative to transfer individual workpieces of said plurality of types to separate work stations for preliminary operations and then to precisely position individual workpieces of different types onto each other for being sewn together at additional sewing work stations.

* * * * *